US007531953B2

(12) United States Patent
Sheng et al.

(10) Patent No.: US 7,531,953 B2
(45) Date of Patent: May 12, 2009

(54) FIELD EMISSION CATHODE WITH FIELD EMITTERS ON CURVED CARRIER AND FIELD EMISSION DEVICE USING THE SAME

(75) Inventors: Lei-Mei Sheng, Beijing (CN); Peng Liu, Beijing (CN); Yang Wei, Beijing (CN); Li Qian, Beijing (CN); Jie Tang, Beijing (CN); Liang Liu, Beijing (CN); Pi-Jin Chen, Beijing (CN); Zhao-Fu Hu, Beijing (CN); Shou-Shan Fan, Beijing (CN)

(73) Assignees: Tsinghua University, Beijing (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 186 days.

(21) Appl. No.: 11/242,099

(22) Filed: Oct. 3, 2005

(65) Prior Publication Data

US 2006/0103288 A1 May 18, 2006

(30) Foreign Application Priority Data

Nov. 12, 2004 (CN) ..... 2004 1 0052265

(51) Int. Cl.
*H01J 1/62* (2006.01)

(52) U.S. Cl. ..... 313/495; 313/336; 313/309

(58) Field of Classification Search ..... 313/495–497, 313/309, 336, 351, 311; 445/49–51
See application file for complete search history.

(56) References Cited

U.S. PATENT DOCUMENTS

| | | | | |
|---|---|---|---|---|
| 5,828,162 | A | 10/1998 | Danroc et al. | |
| 6,239,547 | B1 * | 5/2001 | Uemura et al. | 313/495 |
| 7,239,073 | B2 * | 7/2007 | Takikawa et al. | 313/495 |

FOREIGN PATENT DOCUMENTS

| | | |
|---|---|---|
| CN | 1492469 A | 4/2004 |
| JP | 2001-312953 | 11/2001 |
| TW | 483016 | 4/2002 |

* cited by examiner

*Primary Examiner*—Joseph L Williams

(57) ABSTRACT

A field emission device (8) includes a cathode (80), an anode (84), and spacers (83) interposed therebetween. The cathode includes a network base (81) and a plurality of field emitters (82) formed thereon. The network base is formed of a plurality of electrically conductive carriers. The field emitters are located on surfaces of the carriers, respectively. The field emitters extend radially outwardly from the corresponding conductive carriers. The plurality of electrically conductive carriers may be made of electrically conductive fibers, for example, metal fibers, carbon fibers, organic fibers or another suitable fibrous material. Carrier portions of the plurality of electrically conductive carriers may be cylindrical, curved/arcuate, or at least approximately curved in shape.

13 Claims, 3 Drawing Sheets

FIELD EMISSION CATHODE WITH FIELD EMITTERS ON CURVED CARRIER AND FIELD EMISSION DEVICE USING THE SAME

BACKGROUND OF THE INVENTION

1. Field of the Invention

The present invention relates to field emission technology and, more particularly, to a field emission cathode and a field emission device employing the same.

2. Discussion of the Related Art

Field emission devices operate based on emission of electrons in a vacuum and the subsequent impingement of those electrons on a fluorescent layer, thereby producing illumination. Electrons are emitted from micron-sized tips (i.e. field emitters) in a strong electric field. The electrons are accelerated and then collide with the fluorescent material, thereby producing the light. Field emission devices are thin and light and capable of providing high brightness.

As shown in FIG. 5, a conventional field emission diode 6 generally includes a flat panel cathode 60 and an anode 64 opposite from the cathode 60. Isolating spacers 63 are interposed between the cathode 60 and the anode 64. The cathode 60 includes an electrically conductive flat panel base 61 and a plurality of field emitters 62 formed thereon.

A triode field emission device is another common type of the field emission device. Compared to the diode field emission device, the triode field emission device further includes a grid electrode located between the cathode 60 and the anode 64.

FIG. 6 shows a typical triode field emission device 7. The triode field emission device 7 employs carbon nanotubes 75 as emitters. A first metal film 71 is formed on a back substrate 70 and serves as a cathode. An isolating layer 72 and a second metal film 73 are formed on the first metal film 71. The isolating layer 72 and the second metal film 73 each include a plurality of tiny through holes, such through holes being configured for exposing portions of the first metal film 71. Electrically conductive polymer films 74 are formed on the exposed portions of the first metal film 71 in the through holes. A plurality of carbon nanotubes 75 is formed on the films 74. Spacers 76 are disposed on the second metal film 73. A front substrate including a transparent anode 78 and a fluorescent layer 77 are correspondingly formed on the spacers 76.

However, the above-described field emission devices 6 and 7 both employ flat panel bases for carrying the field emitters. The field emitters are generally densely arranged. Most of the neighboring emitters can become tangled with each other. Therefore, a shielding effect between the adjacent emitters is undesirably enhanced. The performance of the field emission device is impaired, accordingly.

SUMMARY

A field emission cathode provided herein generally includes a network base and a plurality of field emitters. The network base is formed of a plurality of electrically conductive elongate carriers, with at least one portion of each of the carriers having a curved surface. Each field emitter is provided on and extends substantially radially from a given curved surface of a given carrier. The plurality of elongate carriers may be woven to form the network base. Alternatively, the network base may formed of a non-woven batt of the elongate carriers or may be made of a series of aligned carriers metallurgically or adhesively bonded together.

The field emitters each comprise a material selected from metals, non-metals, composites, and essentially one-dimensional nanomaterials, the material advantageously being selected for its emissive properties.

The plurality of electrically conductive carriers used for the network base may be made of any various electrically conductive fibers, for example, metal fibers, carbon fibers, organic fibers or another suitable fibrous material. The plurality of electrically conductive carriers may be cylindrical or oval or otherwise have at least one arcuate or curved surface upon which the emitters may be formed. Alternatively, the carriers could be prism-shaped or polyhedral, especially if enough sides are present so as, together, to substantially approximate a curved surface.

Additionally, a field emission device further provided herein generally includes a field emission cathode and an electron extracting electrode. The field emission cathode incorporates a network base and a plurality of field emitters. The network base is formed of a plurality of electrically conductive elongate carriers, each carrier having at least one portion that forms a curved surface. The plurality of field emitters is provided on the respective carriers. Each field emitter extends substantially radially from a respective curved surface of a particular carrier. The electron extracting electrode disposed spatially corresponding to the field emission cathode.

In one exemplary embodiment, the electronic-extracting electrode is an anode facing toward the field emission cathode. In another exemplary embodiment, the electronic-extracting electrode is a grid electrode. The field emission device may further include an anode facing toward the field emission cathode, and the grid electrode may be disposed between the anode and the field emission cathode. Furthermore, the field emission device may include a gate electrode facing toward the field emission cathode, and the field emission cathode may be disposed between the electron-extracting electrode and the gate electrode.

These and other features, aspects and advantages will become more apparent from the following detailed description and claims, as well as the accompanying drawings.

BRIEF DESCRIPTION OF THE DRAWINGS

Many aspects of the present field emission device can be better understood with reference to the following drawings. The components in the drawings are not necessarily to scale, the emphasis instead being placed upon clearly illustrating the principles of the present device. Moreover, in the drawings, like reference numerals designate corresponding parts throughout the several views.

DETAILED DESCRIPTION OF THE PREFERRED EMBODIMENTS

Figure 1:
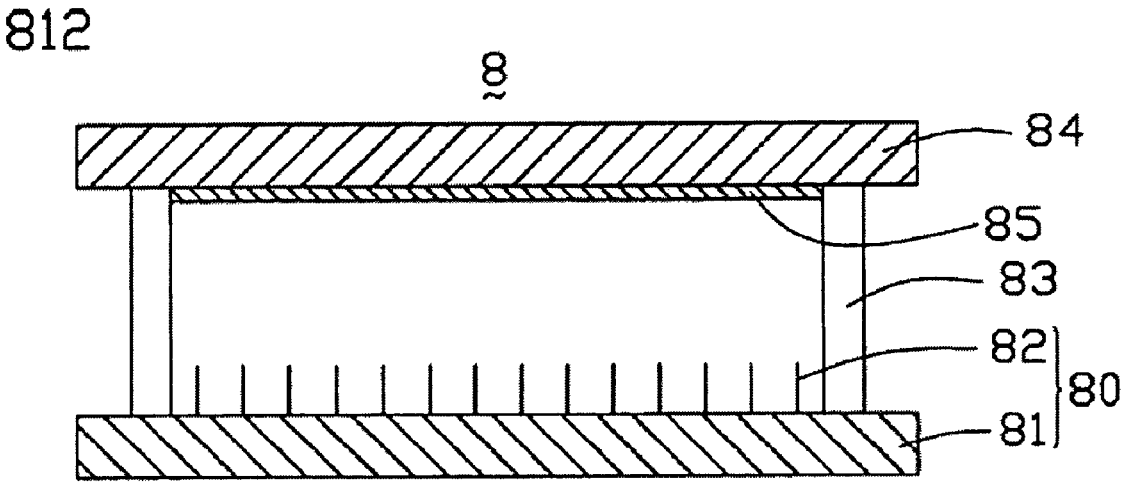
FIG. 1 is a schematic, simplified, cross-sectional view of a field emission device in accordance with a first embodiment of the present device.

Referring to FIG. 1, a field emission device 8 according to a first embodiment of the present device is shown. As a general overview, the field emission device 8 includes a cathode 80 formed on a rear plate (not shown), an anode 84 formed on a front plate (not shown), and spacers 83 interposed therebetween. The cathode 80 and the anode 84 face each other and are parallel with one another. Four lateral sides of the field emission device 8 are sealed by glass plates (not shown). The field emission device 8 maintains an internal vacuum sufficient to permit electrons to move freely.

Figure 2:
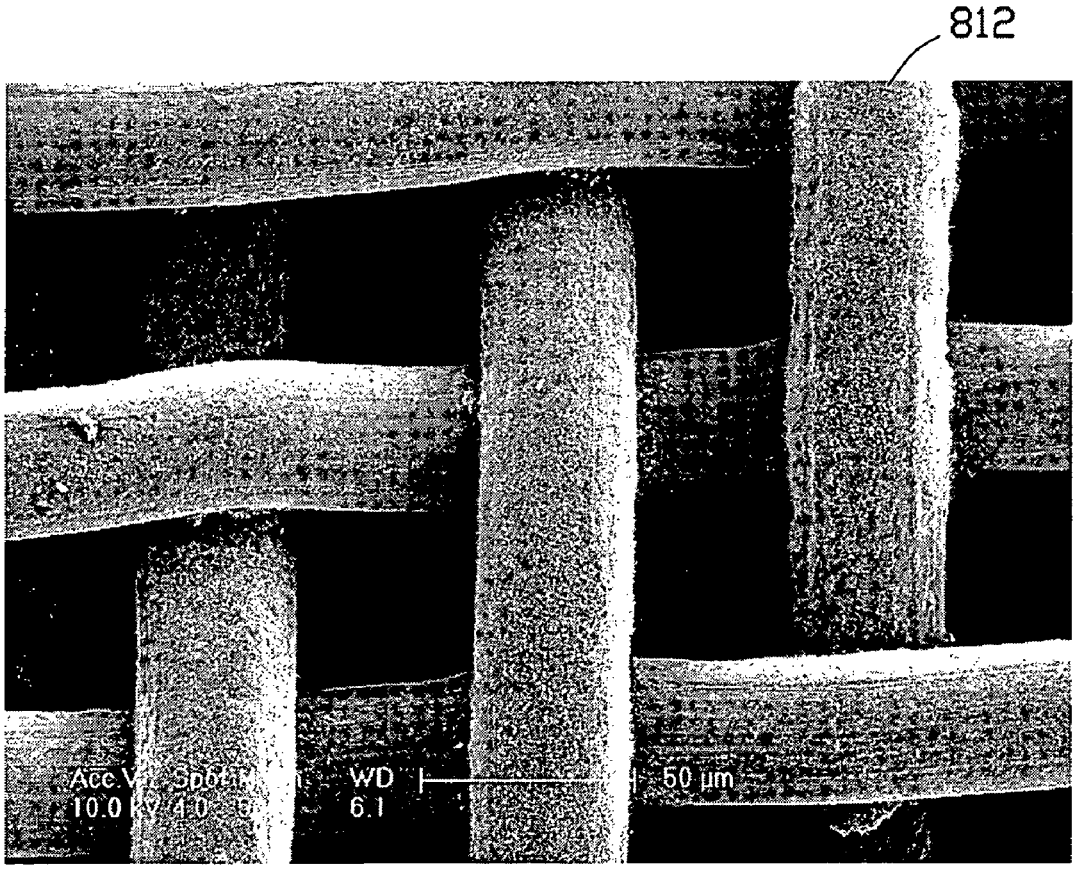
FIG. 2 is an image of carriers of the field emission device of FIG. 1, taken by a scanning electron microscope (SEM)
Figure 3:
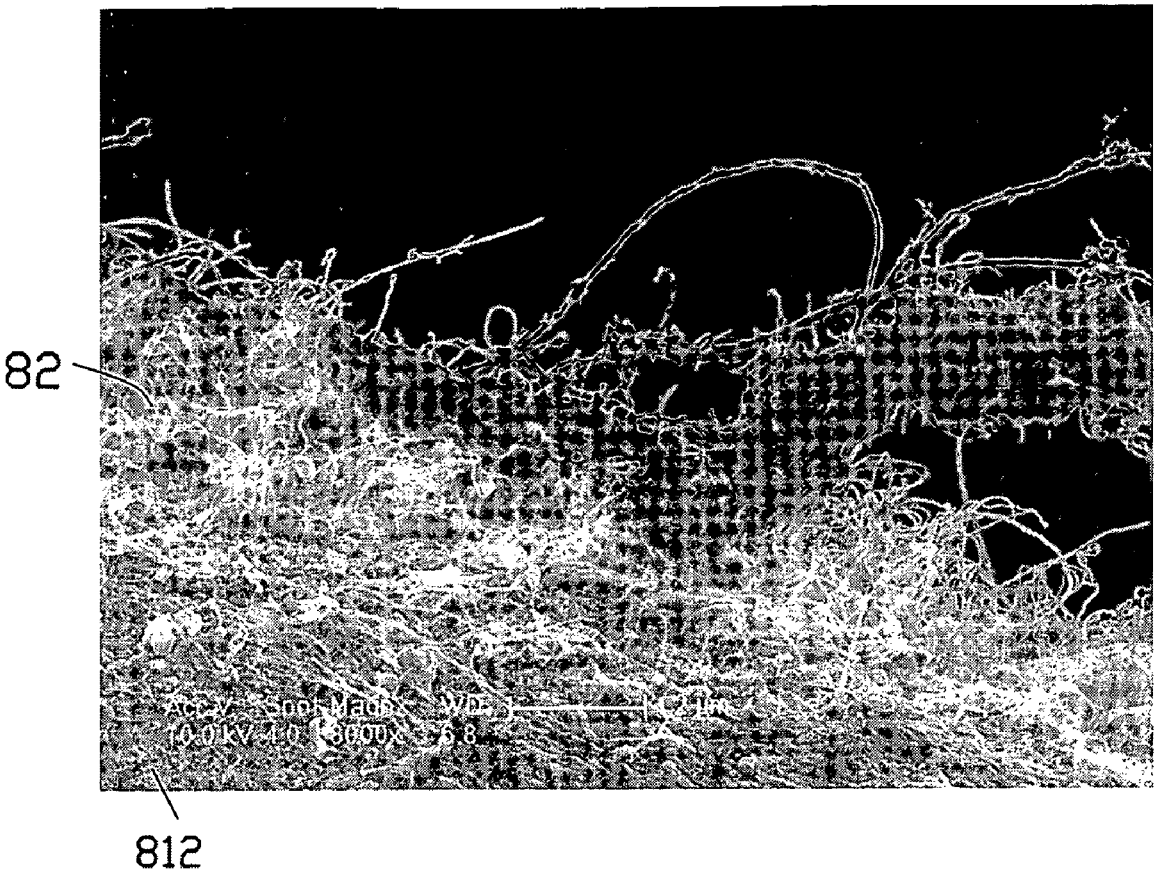
FIG. 3 is an image of carriers, formed with a plurality of field emitters, of the field emission device of FIG. 1, taken by a scanning electron microscope (SEM)

Referring to FIGS. 1, 2, and 3, the cathode 80 includes a base 81 and a plurality of field emitters 82 formed thereon. The base 81 is a flat network body formed of a plurality of electrically conductive carriers 812 interlaced with each other. The field emitters 82 are located on surfaces of the carriers 812, respectively.

FIG. 2 is an image showing the carriers 812, as taken by a scanning electron microscope (SEM). In the illustrated embodiment, the carriers 812 are elongate cylindrical metal wires having diameters in range from several microns to several millimeters. Alternatively, the carriers 812 can be selected from other suitable electrically conductive fibers, such as carbon fibers or organic fibers. In addition, an interlacing density of the carriers 812 is configured according to different requirements.

FIG. 3 is an image showing the carriers 812 with a plurality of field emitters 82 formed thereon, the image being taken using scanning electron microscopy (SEM). The field emitters 82 shown are carbon nanotubes. The field emitters 82 may be formed on the carriers 812 by a screen-printing process, an electrophoresis process, a deposition process, a sputtering process, direct adherence, or any other suitable method. Advantageously, the field emitters 82 are directly grown/formed on the carriers 812.

Preferably, the field emitters 82 are configured to be substantially perpendicular to the surfaces of the corresponding carrier 812. In other words, each of the field emitters 82 extends radially outwardly from an outer circumferential surface of the carrier 812. Preferably, the field emitters 82 are only formed on the outer circumferential surface portions of the respective conductive carriers 812 that are located at a base side facing the anode 84. Understandably, due to the surfaces of the carriers 812 being curved, a first distance between distal ends of neighboring field emitters 82 (i.e., the distance between adjacent emitter tips) is longer/greater than a second distance between proximal ends of the neighboring field emitters 82. Accordingly, tip portions of the field emitters 82 are advantageously configured to be spaced apart the first distance. As such, the shielding effect occurring between neighboring field emitters 82 is effectively minimized or even eliminated. Accordingly, an electron-emitting efficiency of the cathode 80 is increased. As such, the performance of the field emission device 8 is improved.

In addition, the field emitters 82 may be formed of a material selected from the group consisting of metals, non-metals/semidcondutors, compositions (e.g., ceramic oxides, carbides, or nitrides), and other essentially one-dimensional nanomaterials, in addition to carbon. The compositions advantageously include zinc oxide and any other suitable substances known to those skilled in the art. The one-dimensional nanomaterials may include nanotubes or nanowires, such as silicon nanowires and/or molybdenum nanowires. Any material chosen for field emitters 82 advantageously has favorable emissive qualities.

The base 81 may advantageously be obtained by weaving the elongate carriers 812 into a flat network body. The field emitters 82 are formed on the elongate carriers 812 of the base 81. Alternatively, the field emitters 82 could be initially formed on the surfaces of the elongate carriers 812. The carriers 812 with the field emitters 82 formed thereon could then be woven into the base 81.

A variety of conventional methods for manufacturing the carbon nanotubes (for example, a chemical vapor deposition (CVD) method and/or an electric arc discharge method) may be suitably employed to form the carbon nanotubes. For instance, a method of manufacturing carbon nanotubes is described in an article of Shoushan Fan et al., entitled "Self-oriented regular arrays of carbon nanotubes and their field emission properties", published in Science (Vol. 283) 512-514 on Jan. 22, 1999, which is incorporated herein by reference.

Generally, the anode 84 is a transparent conductive layer formed on a surface of the front plate that faces the cathode. The anode 84 may advantageously be formed by depositing indium-tin oxide on the surface of the front plate. A fluorescent layer 85 is formed on the anode 84 and faces the carriers 812. The fluorescent layer 85 is patterned to include a plurality of pixels. In operation, a high voltage is applied between the anode 84 and the cathode 80 such that electrons are extracted from the field emitters 82 and are accelerated to bombard the fluorescent layer 85.

Figure 4:
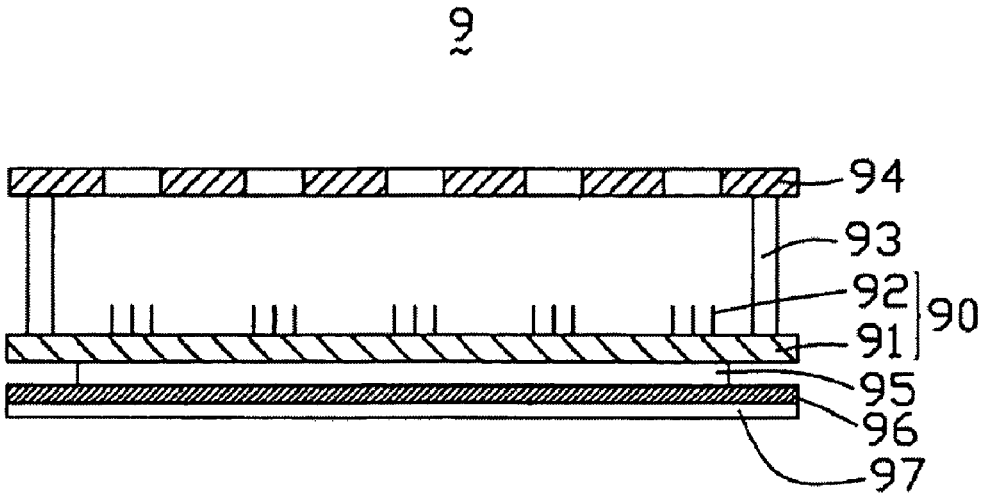
FIG. 4 is a schematic, simplified, cross-sectional view of a field emission device in accordance with a second embodiment of the present invention.
Figure 5:
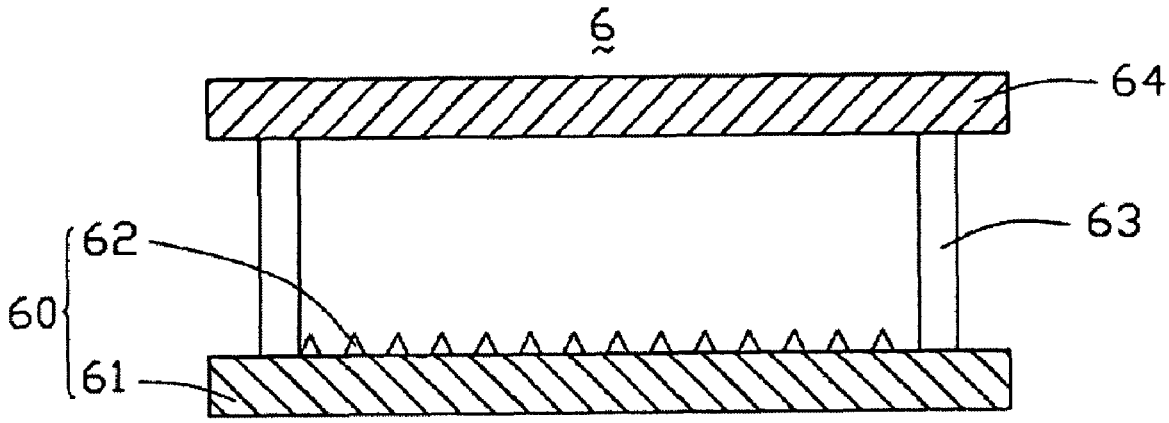
FIG. 5 (PRIOR ART)
FIG. 5 is a schematic, cross-sectional view of a conventional diode field emission device.
Figure 6:
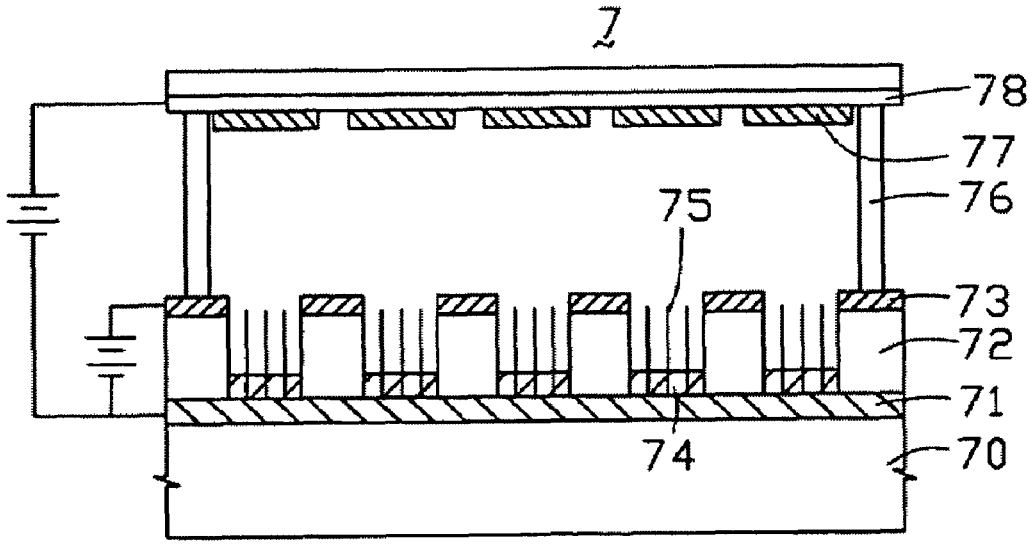
FIG. 6 (PRIOR ART)
FIG. 6 is a schematic, cross-sectional view of a conventional triode field emission device.

FIG. 4 represents a field emission cathode device 9 according to a second embodiment of the present device. The field emission cathode device 9 includes a substrate 97, a gate electrode 96 formed on the substrate 97, a cathode 90, and a grid electrode 94. A first isolating layer 95 is sandwiched between the gate electrode 96 and the cathode 90. A second isolating layer 93 is interposed between the cathode 90 and the grid electrode 94.

Similarly, the cathode 90 includes a base 91 and a plurality of field emitters 92 formed thereon. The base 91 is a flat network body, formed of a plurality of electrically conductive elongate carriers 812 (not labeled in FIG. 4) interlaced with each other. The field emitters 92 are formed on outer circumferential surface of the carriers 812. Preferably, the field emitters 92 are substantially perpendicular to the outer circumferential surfaces of the corresponding carrier 812.

The grid electrode 94 and the second isolating layer 93 define a plurality of apertures (not labeled), spatially corresponding to the field emitters 92, such apertures being configured for allowing electrons to pass therethrough. Alternatively, the first and second insulating layers 95, 93 could be made of an insulating material such as $SiO_2$, polyimide, a nitride, and/or a composite made of such materials.

In operation, working voltages applied to the grid electrode 94, the cathode 90, and the gate electrode 96 are markedly reduced. Due to the existence of the gate electrode 96, the working voltage applied to the grid electrode 94 is decreased.

The field emission cathode device 9 can be employed to be assembled to an anode (not shown in FIG. 4, but similar to that shown in FIG. 1) to thereby constitute a field emission apparatus, such as a field emission lamination device, a field emission display, or a field emission scanning microscope. The anode is generally disposed above the grid electrode 94 and faces the cathode 90. A plurality of spacers (not shown in FIG. 4) is advantageously interposed between the anode and the cathode 90.

It should be noted that the carriers 812 may be configured to have other suitable shapes to practice the present field emission device. For example, the carriers 812 may alternatively be oval or otherwise have at least one arcuate/curved surface upon which the emitters may be formed. Alternatively, the carriers could be prism-shaped or polyhedral, especially if enough sides are present so as, together, to substantially approximate a curved surface (e.g., six longitudinal faces minimum; preferably 10 or more such faces).

Finally, while the present invention has been described with reference to particular embodiments, the description is intended to be illustrative of the invention and is not to be construed as limiting the invention. Therefore, various modifications can be made to the embodiments by those skilled in the art without departing from the true spirit and scope of the invention as defined by the appended claims.

We claim:

1. A field emission cathode for a field emission device, the field emission cathode comprising:

a network base formed of a plurality of electrically conductive elongate carriers, at least one portion of each carrier having a curved surface; and a plurality of field emitters, each field emitter comprising a distal end and a proximal end, the proximal end attached to the curved surface of each of the carrier, the distal end extending substantially radially from the curved surface of each of the carrier, wherein a first distance between distal ends of neighboring field emitters is greater than a second distance between proximal ends of the neighboring field emitters.

2. The field emission cathode according to claim 1, wherein the electrically conductive carriers are cylindrical.

3. The field emission cathode according to claim 1, wherein the field emitters are comprised of a material selected from the group consisting of metals, non-metals, semiconductors, ceramic compositions, and essentially one-dimensional nanomaterials.

4. A field emission device comprising:

a field emission cathode comprising:

a network base formed of a plurality of electrically conductive elongate carriers, at least one portion of each carrier having a curved surface; and a plurality of field emitters, each field emitter comprising a distal end and a proximal end, the proximal end attached to the curved surface of one corresponding carrier, the distal end extending substantially radially from the curved surface of the one carrier, wherein a first distance between distal ends of neighboring field emitters is greater than a second distance between proximal ends of the neighboring field emitters; and an electron extracting electrode disposed spatially corresponding to the field emission cathode.

5. The field emission device according to claim 4, wherein the electrically conductive carriers are cylindrical.

6. The field emission device according to claim 4, wherein the field emitters are comprised of a material selected from the group consisting of metals, non-metals, semiconductors, ceramic compositions, and essentially one-dimensional nanomaterials.

7. The field emission device according to claim 4, wherein the electron extracting electrode is an anode.

8. The field emission device according to claim 4, wherein the electron extracting electrode is a grid electrode.

9. The field emission device according to claim 8, further comprising an anode facing toward the field emission cathode, the electron-extracting electrode being disposed between the anode and the field emission cathode.

10. The field emission device according to claim 4, further comprising a gate electrode facing toward the field emission cathode, the field emission cathode being disposed between the electron extracting electrode and the gate electrode.

11. A field emission cathode for a field emission device, the field emission cathode comprising:

a network base formed of a plurality of electrically conductive elongate cylindrical wires interlaced with each other, each of the elongate cylindrical wires having a curved surface; and a plurality of field emitters, each of the field emitters comprising a distal end and a proximal end, the proximal end attached to the curved surface of each of the elongate cylindrical wires, the distal end extending substantially radially from the curved surface of each of the elongate cylindrical wires, wherein a first distance between distal ends of neighboring field emitters is greater than a second distance between proximal ends of the neighboring field emitters.

12. The field emission cathode according to claim 11, wherein the network base is an essentially flat elongate-cylindrical-wires-woven base.

13. The field emission cathode according to claim 11, wherein the elongate cylindrical wires are comprised of a material selected from the group consisting of metals, non-metals, semiconductors, ceramic compositions, and essentially one-dimensional nanomaterials.

* * * * *